US010159331B2

(12) United States Patent
Akashi et al.

(10) Patent No.: US 10,159,331 B2
(45) Date of Patent: Dec. 25, 2018

(54) POLISHING BRUSH AND POLISHING METHOD

(71) Applicants: TAIMEI CHEMICALS CO., LTD., Nagano (JP); XEBEC TECHNOLOGY CO., LTD., Tokyo (JP)

(72) Inventors: Mitsuhisa Akashi, Nagano (JP); Norihiko Sumiyoshi, Tokyo (JP)

(73) Assignees: TAIMEI CHEMICALS CO., LTD., Nagano (JP); XEBEC TECHNOLOGY CO., LTD., Tokyo (JP)

( * ) Notice: Subject to any disclaimer, the term of this patent is extended or adjusted under 35 U.S.C. 154(b) by 209 days.

(21) Appl. No.: 14/898,522

(22) PCT Filed: Jun. 24, 2014

(86) PCT No.: PCT/JP2014/066730
§ 371 (c)(1),
(2) Date: Dec. 15, 2015

(87) PCT Pub. No.: WO2014/208566
PCT Pub. Date: Dec. 31, 2014

(65) Prior Publication Data

US 2016/0128461 A1 May 12, 2016

(30) Foreign Application Priority Data

Jun. 25, 2013 (JP) ..... 2013-133175

(51) Int. Cl.
*B24B 7/18* (2006.01)
*B24D 13/14* (2006.01)
(Continued)

(52) U.S. Cl.
CPC ..... *A46B 11/00* (2013.01); *A46B 7/023* (2013.01); *A46D 3/04* (2013.01); *A46D 3/08* (2013.01);
(Continued)

(58) Field of Classification Search
CPC ..... B24B 7/18; B24D 13/14; A46B 13/02
(Continued)

(56) References Cited

U.S. PATENT DOCUMENTS 3,345,281 A 10/1967 Falls
7,434,289 B2 * 10/2008 Sumiyoshi ..... A46B 13/008 15/179
(Continued)

FOREIGN PATENT DOCUMENTS

EP 0342315 A2 2/1991
EP 1797993 A1 6/2007
(Continued)

OTHER PUBLICATIONS

International Search Report for PCT/JP2014/066730, dated Jul. 22, 2014.
(Continued)

*Primary Examiner* — Robert Rose

(57) ABSTRACT

A polishing brush (1) includes a plurality of linear abrasive members (32) each formed by hardening an aggregated yarn of inorganic filaments by a resin binder, and a holder (2) that holds the linear abrasive members (32). The linear abrasive members (32) are held by a base (31). The base (31) is secured to a spindle (25) in the holder (2). In the spindle (25), a flow path (28) for discharging a liquid cutting agent toward a side on which free ends (33) of the linear abrasive members (32) are located is provided.

9 Claims, 15 Drawing Sheets

(51) Int. Cl.

| | |
|---|---|
| ***A46B 11/00*** | (2006.01) |
| ***A46B 7/02*** | (2006.01) |
| ***B08B 1/00*** | (2006.01) |
| ***A46D 3/04*** | (2006.01) |
| ***A46D 3/08*** | (2006.01) |
| *A46B 13/02* | (2006.01) |

(52) U.S. Cl.
CPC ..... *B08B 1/002* (2013.01); *B24D 13/14* (2013.01); *A46B 13/02* (2013.01); *A46B 2200/3086* (2013.01)

(58) Field of Classification Search
USPC ..... 451/450, 59, 53
See application file for complete search history.

(56) References Cited

U.S. PATENT DOCUMENTS

| | | | | |
|---|---|---|---|---|
| 2005/0153642 | A1* | 7/2005 | Matsushita ..... | A46B 13/008 451/526 |
| 2011/0289717 | A1* | 12/2011 | Dhanvanthari ..... | A46B 13/001 15/322 |

FOREIGN PATENT DOCUMENTS

| | | | |
|---|---|---|---|
| JP | S46-027578 | Y | 9/1971 |
| JP | S49-041864 | U | 4/1974 |
| JP | S50-015364 | U | 2/1975 |
| JP | S57-137333 | U | 2/1981 |
| JP | S59-89113 | U | 6/1984 |
| JP | S63-052962 | A | 3/1988 |
| JP | S64-5734 | A | 1/1989 |
| JP | H03-234460 | A | 10/1991 |
| JP | 2003-136413 | A | 5/2003 |

OTHER PUBLICATIONS

Japan Patent Office, Office Action for Japanese patent application No. 2015-524066, dated Nov. 21, 2017.
Japan Patent Office, Office Action for Japanese patent application No. 2015-524066, dated Mar. 6, 2018.
The State Intellectual Property Office of People's Republic of China, First Office Action for Chinese Patent Application No. 201480034139.6, dated Aug. 15, 2016.
The State Intellectual Property Office of People's Republic of China, Search Report for Chinese Patent Application No. 201480034139.6, dated Aug. 4, 2016.

* cited by examiner

POLISHING BRUSH AND POLISHING METHOD

FIELD

The present invention relates to a polishing brush including a holder that holds linear abrasive members formed by hardening inorganic filaments by a resin binder, and to a polishing method using the polishing brush. Note that, in the following description, linear abrasive members exert, at the tips thereof, an effect similar to grinding while polishing a workpiece. In addition, the linear abrasive members exert, at the tips thereof, the effect similar to grinding while deburring the workpiece. Thus, the following description does not discriminate between "polishing" and "grinding".

BACKGROUND

A brush-like grinding stone has been introduced (Patent Literature 1), which includes a holder that holds bundles of a plurality of linear abrasive members each formed by hardening an aggregated yarn of inorganic filaments, such as aluminum filaments, by a resin binder. When such a brush-like grinding stone is used for polishing or deburring the surface of a metallic workpiece, polishing is performed with the tips of the linear abrasive members while the brush-like grinding stone is rotating about the axial line thereof.

CITATION LIST

Patent Literature

Patent Literature 1: Japanese Patent Laid-open Publication No. 2003-136413

SUMMARY

Technical Problem

The brush-like grinding stone disclosed in, for example, Patent Literature 1 uses an ability of polishing provided by the tips of the linear abrasive members. Hence, the tips of the linear abrasive members clog with cutting dust in the course of grinding, thereby resulting in the problem of decreasing polishing performance.

In light of the problem, an object of the present invention is to provide a polishing brush capable of keeping the polishing performance from decreasing due to the tips of the linear abrasive members clogged with cutting dust and to provide a polishing method using the polishing brush.

Solution to Problem

In order to solve the problem, a polishing brush according to the present invention includes: a plurality of linear abrasive members; and a holder that holds the linear abrasive members. The holder is provided with a flow path for discharging a liquid cutting agent toward a side on which free ends of the linear abrasive members are located.

In addition, a polishing method of the present invention using a polishing brush including a plurality of linear abrasive members and a holder that holds the linear abrasive members includes the steps of: providing the holder with a flow path for discharging a liquid cutting agent toward a side on which free ends of the linear abrasive members are located; and discharging the liquid cutting agent toward the side on which the free ends of the linear abrasive members are located when a workpiece is polished by moving the polishing brush and/or the workpiece relative to one another while the free ends of the linear abrasive members touch the workpiece.

The present invention uses the tips of the linear abrasive members to polish the workpiece. Because the holder is provided with the flow path in the present invention, although cutting dust tends to clog the tips of the linear abrasive members in the course of polishing, the liquid cutting agent is efficiently supplied to the tips of the linear abrasive members from the flow path. Consequently, cutting dust can be flown out efficiently. Thus the tips of the linear abrasive members are hard to be clogged with cutting dust. As a result, the polishing performance can be kept from decreasing.

In the present invention, it is preferred that the flow path be opened in a region in the holder surrounded by the linear abrasive members. With this configuration, the cutting agent is supplied from the inside of the region surrounded by the linear abrasive members to the outside, and thus cutting dust is efficiently flown out. Consequently, the tips of the linear abrasive members are hard to be clogged with cutting dust.

In the present invention, it is preferred that the polishing brush further include a base that holds base ends of the linear abrasive members. The holder may include a brush case that holds therein the base so that the free ends of the linear abrasive members project from an open end of the brush case. The brush case may be provided with a spindle extending in the brush case along a direction of an axial line thereof. The base may be provided with a shaft hole into which the spindle fits in a region surrounded by the linear abrasive members. The flow path may extend in the spindle in the direction of the axial line and opened at an end on the side on which the free ends of the linear abrasive members are located. With the configuration, a structure in which the flow path is opened in the region surrounded by the linear abrasive members can be implemented even if the base holding the linear abrasive members is held in the brush case.

In the present invention, the brush case includes a peripheral wall that may be provided with a groove-like guide hole extending in the direction of the axial line. The base may be provided with a screw hole reaching the shaft hole from an outer circumferential surface of the base. The base may be held between the spindle and the peripheral wall with a set screw, the set screw being screwed in the screw hole through the guide hole so that a tip of the set screw contacts an outer circumferential surface of the spindle. With the configuration, the projection length of the linear abrasive members at the open end of the brush case can be adjusted.

In the present invention, the spindle may constitute a shank that projects from the brush case to an opposite side of the side on which the free ends of the linear abrasive members are located and enables connection to a rotary driving unit of a polishing machine. With this configuration, the polishing brush can be easily connected to the rotary driving unit of the polishing machine. In addition, the cutting agent can be discharged at the center of the region in which the linear abrasive members rotate because the polishing brush rotates about the spindle. Consequently, cutting dust can be flown out efficiently. Thus the tips of the linear abrasive members are hard to be clogged with cutting dust.

In the present invention, a structure in which the flow path is opened in the direction of the axial line at the end of the spindle may be adopted.

In the present invention, a structure in which the flow path is opened in a direction intersecting with the direction of the axial line at the end of the spindle may be adopted. With this configuration, the liquid cutting agent can be discharged to a wide range.

In the present invention, the holder may include a base that holds base ends of the linear abrasive members, and a shank configured to enable connection to a rotary driving unit of a polishing machine. The shank may project from the base to an opposite side of the side on which the free ends of the linear abrasive members are located, and the flow path may pass through the shank and the base. With this configuration, the polishing brush can be easily connected to the rotary driving unit of the polishing machine. In addition, the cutting agent can be supplied from the polishing machine easily.

In the present invention, the polishing brush may further include a nozzle secured to the holder and directing discharge of the cutting agent discharged through the flow path to the side on which the linear abrasive members are located. With this configuration, the linear abrasive members can be cooled by applying the cutting agent onto the linear abrasive members.

In the present invention, the linear abrasive members may each include an aggregated yarn of inorganic filaments.

In the present invention, the linear abrasive members may each have a circular cross-sectional shape. When the linear abrasive members each having a circular cross-sectional shape are used for polishing, for example, a workpiece having a smooth surface, the contact area between the linear abrasive members and the workpiece is large, and thus the tips of the linear abrasive members can be clogged with the cutting dust easily. By contrast, the tips of the linear abrasive members can be prevented from being clogged with the cutting dust by discharging the cutting agent from the flow path to the side on which the free ends of the linear abrasive members are located.

With the present invention, because the holder is provided with the flow path, the liquid cutting agent is efficiently supplied to the tips of the linear abrasive members from the flow path. Consequently, cutting dust can be flown out efficiently. Thus the tips of the linear abrasive members are hard to be clogged with cutting dust. As a result, the polishing performance can be kept from decreasing.

DESCRIPTION OF EMBODIMENTS

Embodiments of the present invention are described below with reference to the drawings.

First Embodiment

Entire Structure

Figure 1:
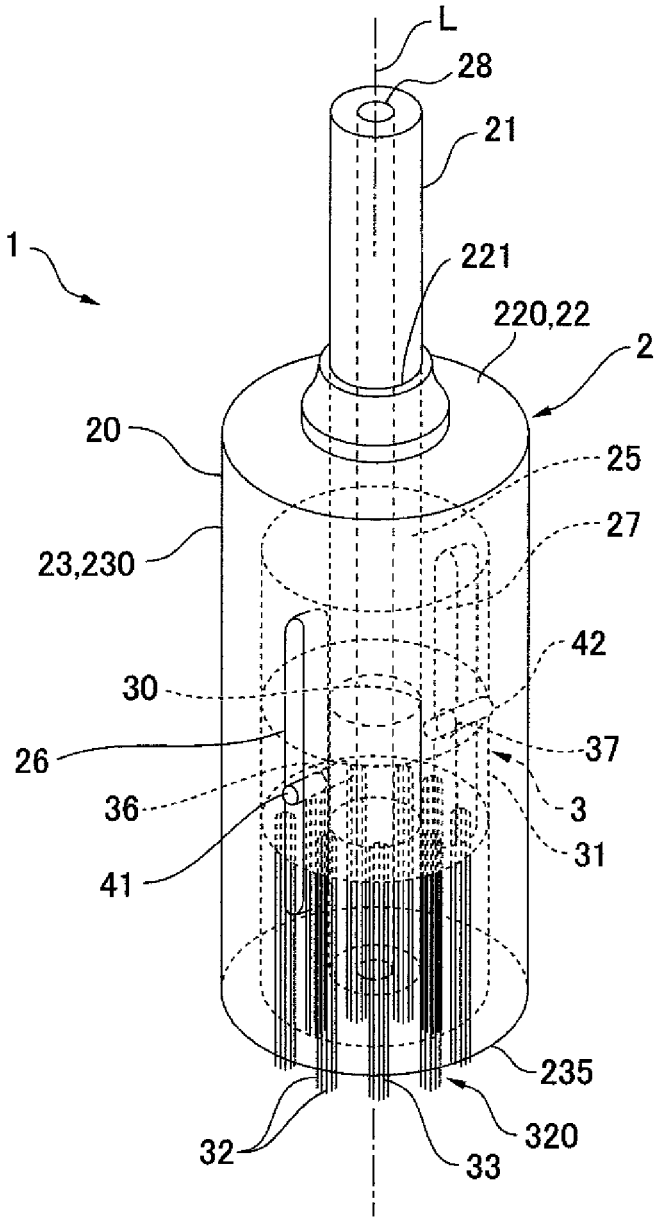
FIG. 1 is an illustration of a polishing brush according to a first embodiment of the present invention in a state that a top (base side) of a brush-like grinding stone is inserted in and secured to a brush case.
Figure 2:
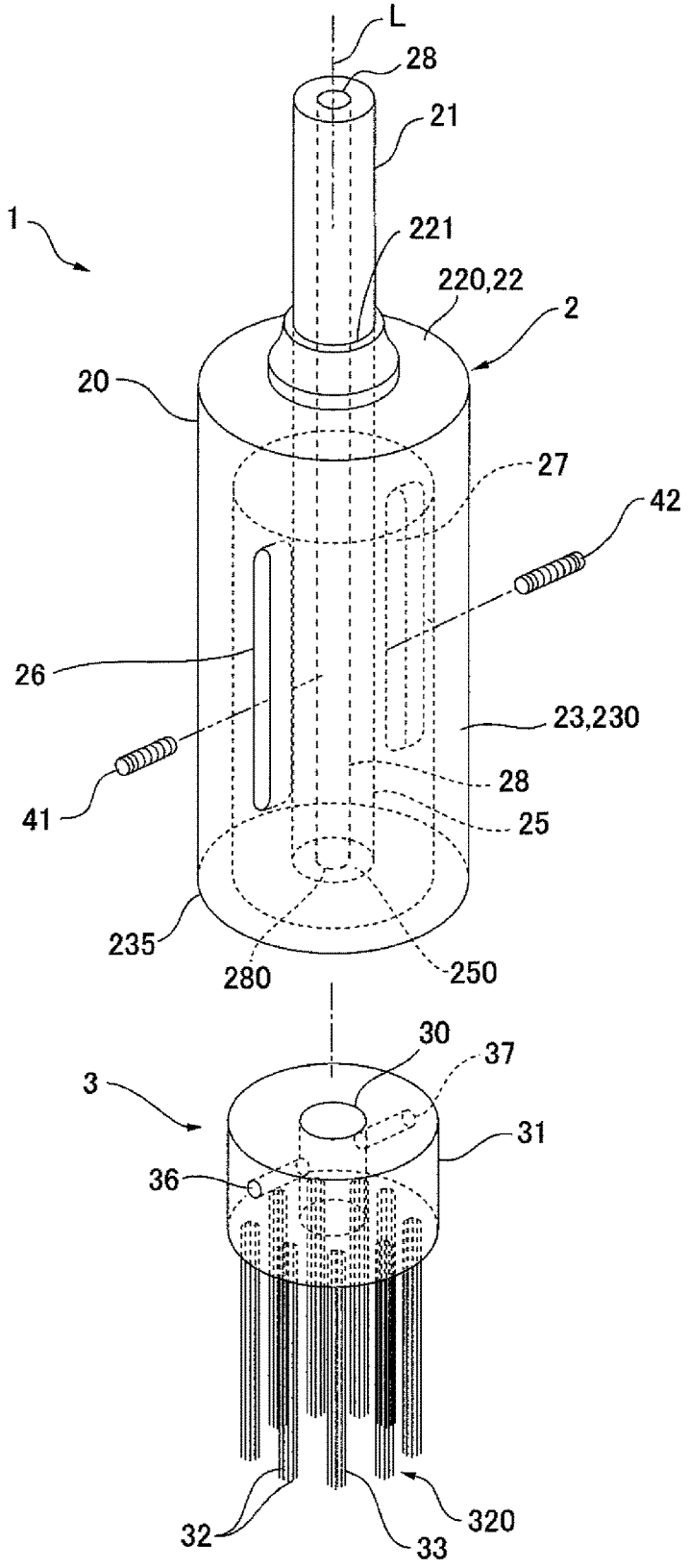
FIG. 2 is an exploded perspective view illustrating the polishing brush illustrated in FIG. 1 disassembled into the brush case and the brush-like grinding stone.
Figure 3:
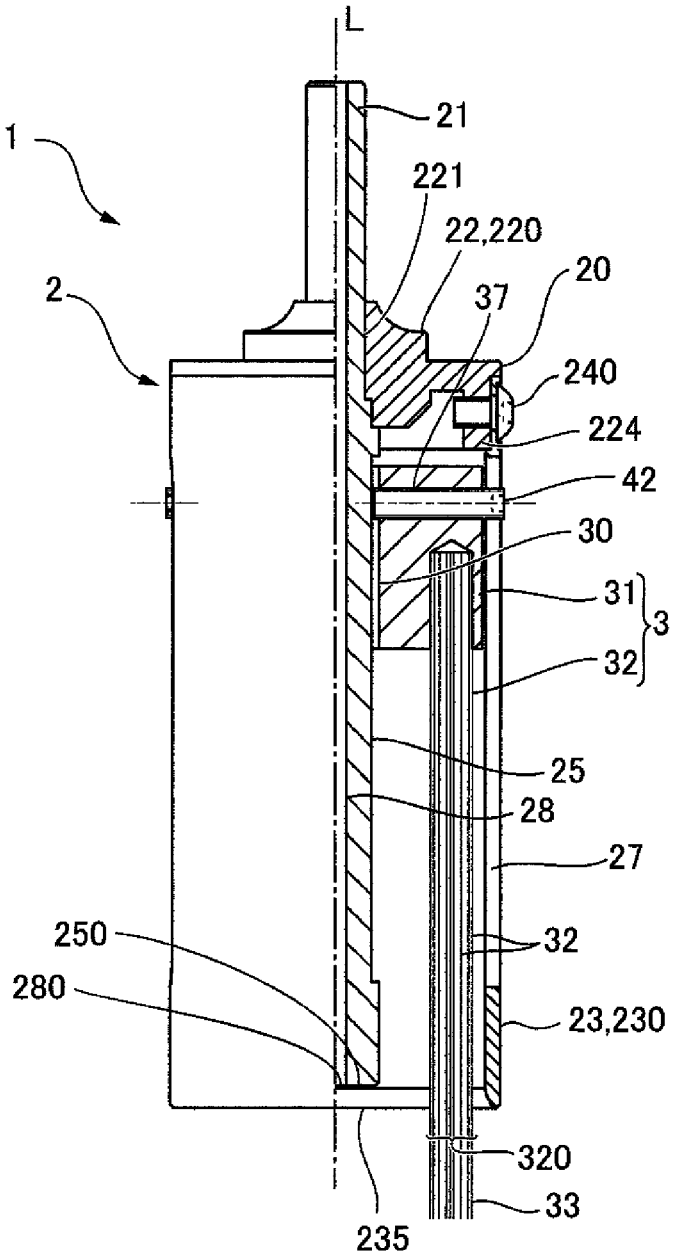
FIG. 3 is a half section illustrating a partial cut of the polishing brush illustrated in FIG. 1.

FIG. 1 is an illustration of a polishing brush according to a first embodiment of the present invention in a state that a top (base side) of a brush-like grinding stone is inserted in and secured to a brush case. FIG. 2 is an exploded perspective view illustrating the polishing brush illustrated in FIG. 1 disassembled into the brush case and the brush-like grinding stone. FIG. 3 is a half section illustrating a partial cut of the polishing brush illustrated in FIG. 1.

As illustrated in FIG. 1 and FIG. 2, a polishing brush 1 of the present embodiment includes a plurality of linear abrasive members 32 each formed by hardening an aggregated yarn of inorganic filaments, such as aluminum filaments, by a resin binder, and a holder 2 that holds the linear abrasive members 32, and is used for polishing a workpiece with the free ends (tips) of the linear abrasive members 32. In the present embodiment, the base end side of each of the linear abrasive members 32 is held by the base 31. The base 31 and the linear abrasive members 32 form a brush-like grinding stone 3. The holder 2 holds the linear abrasive members 32 through the base 31.

The linear abrasive members 32 each are an aggregate of inorganic filaments, such as aluminum filaments, that is impregnated with a resin binder, such as an epoxy resin and a silicone resin, and is thereafter cured and shaped in a line. The aggregated yarn is an aggregate of 250 to 3000 aluminum filaments (inorganic filaments) having a filament diameter of 8 to 50 μm. The aggregated yarn has a diameter of 0.1 mm to 2 mm. Hence, as with the aggregated yarn, each of the linear abrasive members 32 has a diameter of 0.1 mm to 2 mm. The inorganic filaments are not limited to a particular material as long as the material has a polishing property relative to a polishing target, that is, the material is harder and more fragile than the polishing target. For example, silicon carbide fibers, boron fibers, and grass fibers, in addition to aluminum fibers, can be used as the inorganic filaments. Note that these materials may be mixed depending on the polishing target. The aluminum fibers and the silicon carbide fibers have an excellent polishing property against a ferrous based metal and a non-ferrous based metal.

Each of the linear abrasive members 32 has a cross-sectional shape of a circle, a regular polygon, or a flat shape. In this application, a circle means a perfect circle or a substantially perfect circle the flatness (thickness/width) of which is smaller than 1.1. A regular rectangle means, for example, a square and a regular hexagon. A flat shape means, for example, an ellipse, an oval, or a rectangle. In the present embodiment, the linear abrasive members 32 each having a circular cross-sectional shape are used. Note that, when the linear abrasive members 32 each having a rectangular or an elliptic cross-sectional shape are used, the preferable flatness is 1.1 to 5.0.

The holder 2 includes a cylindrical metallic brush case 20 and set screws 41 and 42. The brush case 20 is provided with a driving connecting shaft (a shank) 21 on the top thereof. The set screws 41 and 42 secure the base 31 to a certain position in the brush case 20.

As illustrated in FIG. 3, the brush case 20 includes a metallic end plate 220 forming an upper bottom 22, a metallic cylinder 230 forming a peripheral wall 23, and a metallic spindle 25 having a round bar shape secured to the upper bottom 22 with being fitted in a center hole 221 in the upper bottom 22. The cylinder 230 is secured to a side plate 224 on the end plate 220 with a screw 240. The spindle 25 projects upward from the upper bottom 22. A part of the spindle 25 projecting upward from the upper bottom 22 forms the driving connecting shaft 21. The spindle 25 extends in the brush case 20 along the direction of an axial line L on the same axis as the peripheral wall 23.

As illustrated in FIG. 1 to FIG. 3, the peripheral wall 23 of the brush case 20 is provides with groove-like guide holes 26 and 27 extending parallel to the direction of the axial line L on point symmetric positions with respect to the axial line L. In the present embodiment, the peripheral wall 23 and the spindle 25 of the brush case 20 are aluminum and stainless steel, respectively.

The base 31 is a cylindrical body that holds bundles 320 obtained by bundling up the linear abrasive members 32 at one end surface of the cylindrical body. The base 31 is provided with, in the center thereof, a shaft hole 30 through which the spindle 25 is inserted. In the present embodiment, the bundles 320 of the linear abrasive members 32 are held at the one end surface of the base 31 at a regular angular distance around the shaft hole 30. Consequently, in a state that the spindle 25 is inserted in the base 31, the linear abrasive members 32 are extending along the axial line L around the spindle 25. The peripheral wall of the base 31 is provided with a pair of screw holes 36 and 37 on point symmetric positions with respect to the axial line L. The screw holes 36 and 37 reach the shaft hole 30 from an outer circumferential surface of the peripheral wall of the base 31.

(Structure of Flow Path)

In the polishing brush 1 of the present embodiment, the holder 2 is provided with a flow path 28 to discharge a liquid cutting agent toward the side on which the free ends 33 of the linear abrasive members 32 are located. In order to provide the flow path 28, a circular tube member is used as the spindle 25 in the present embodiment. Hence, the inside of the spindle 25 is provided with the flow path 28 extending along the axial line L. The flow path 28 is opened as a discharging port 280 at a bottom end surface 250 (end) of the spindle 25. Consequently, the discharging port 280 of the flow path 28 are opened in a region in the holder 2 surrounded by the linear abrasive members 32.

(Assembling Method of Polishing Brush 1)

In order to assemble the polishing brush 1 of the present embodiment, the top (the base 31 side) of the brush-like grinding stone 3 is inserted in the brush case 20 so that the spindle 25 fits in the shaft hole 30 of the base 31. Thereafter, the set screws 41 and 42 are inserted in the guide holes 26 and 27, respectively, from the outer circumference of the brush case 20, and the set screws 41 and 42 are secured to the screw holes 36 and 37 of the base 31, respectively. In this process, the set screws 41 and 42 are tightened until the tips of the set screws 41 and 42 abut on the outer circumferential surface of the spindle 25. As a result, in the brush case 20, the base 31 is secured to the spindle 25 of the brush case 20 through the set screws 41 and 42.

In this process, the set screws 41 and 42 are screwed shallowly in the respective screw holes 36 and 37 of the base 31 through the respective guide holes 26 and 27 of the brush case 20, and in this state, by moving the brush-like grinding stone 3 in the brush case 20 in the direction of the axial line L, the position of the brush-like grinding stone 3 in the direction of the axial line L in the brush case 20 can be adjusted. Consequently, the projection length of the free ends 33 of the linear abrasive members 32 at the bottom end 235 of the brush case 20 can be adjusted. Thus, the stiffness, in other words, the grinding property and flexibility of the linear abrasive members 32 can be optimized.

In the present embodiment, although hexagon socket set screws are used as the set screws 41 and 42, screws having heads and shafts may be used. In the present embodiment, although the guide holes 26 and 27 extend parallel to the axial line L, the guide holes 26 and 27 may extend oblique to the axial line L.

(Polishing Method Using Polishing Brush 1)

The polishing brush 1 of the present embodiment is connected to a polishing machine through the driving connecting shaft 21 projecting from the top of the brush case 20. In addition, in the polishing machine, the polishing brush 1 is rotary driven about the axial line L in a state that the tips of the free ends of the linear abrasive members 32 contact a workpiece and, for example, used for polishing and deburring various workpieces. The polishing brush 1 may be set to perform motion including not only rotation but also reciprocation, oscillation, swing, and combination thereof. In addition, vertical motion of the polishing brush 1 in the direction of the axial line L may be combined.

When the above mentioned polishing and deburring are performed, in the present embodiment, the liquid cutting agent is supplied to the flow path 28 formed in the spindle 25 of the polishing 1 through the driving connecting shaft 21 and is discharged from the discharging port 280. As a result, cutting dust generated between the tips of the linear abrasive members 32 and the workpiece is flown out with the cutting agent. The cutting agent may be an oil-based cutting agent (machining oil) or a water-soluble cutting agent.

Through the above mentioned polishing and deburring, the linear abrasive members 32 themselves are worn down and the projection length of the linear abrasive members 32 at the bottom end 235 of the brush case 20 is shortened. In such a state, excellent deburring or polishing cannot be performed. Thus, the stiffness, in other words, the grinding property and flexibility of the linear abrasive members 32 should be adjusted by adjusting the projection length of the linear abrasive members 32 at the bottom end 235 of the brush case 20. In order to perform such adjustment, the set screws 41 and 42 are loosened, and, by moving the brush-like grinding stone 3 in the brush case 20 in the direction of the axial line L, the position of the brush-like grinding stone 3 in the direction of the axial line L in the brush case 20 is displaced downward. Consequently, the projection length of the free ends 33 of the linear abrasive members 32 at the bottom end 235 of the brush case 20 can be adjusted to an optimal length again. In this process, the set screws 41 and 42 are guided with the guide holes 26 and 27, respectively, whereby the brush-like grinding stone 3 is moved in the brush case 20 along the guide holes 26 and 27. In addition, in the present embodiment, the base 31 is in a state of being fitted in the brush case 20 and the spindle 25 fits in the shaft hole 30 of the base 31. Hence, the base 31 is not inclined in the brush case 20 even if the dimensional tolerance between the outer diameter of the base 31 and the inner diameter of the brush case 20 is not strict. Consequently, variance in the projection length of the linear abrasive members 32 at the bottom end 235 of the brush case 20 does not occur. As a result, the grinding depth of the linear abrasive members 32 against the workpiece is constant, and thus the grinding accuracy improves. In addition, because the base 31 can be secured to the center of the brush case 20 even if the dimensional tolerance between the outer diameter of the base 31 and the inner diameter of the brush case 20 is not strict, eccentricity in rotation does not occur.

In addition, if the linear abrasive members 32 tend to escape toward the outer circumference when the polishing brush 1 rotates about the axial line L, the linear abrasive members 32 abut on the inner surface of the peripheral wall 23 of the brush case 20, and thus the escape toward the outer circumference is suppressed. If the linear abrasive members 32 tend to escape toward the inner circumference, the linear abrasive members 32 abut on the outer surface of the spindle 25, and thus the escape toward the inner circumference is suppressed. Hence, the linear abrasive members 32 positioned on the outer circumferential side and the linear abrasive members 32 positioned on the inner circumferential side have no difference in the easiness of escape. Consequently, the linear abrasive members 32 positioned o the outer circumferential side and the linear abrasive members 32 positioned on the inner circumferential side have no difference in rigidity, and thus the situation that the linear abrasive members 32 positioned on the inner circumferential side have less abrasion can be prevented. As a result, the linear abrasive members 32 are uniformly worn down, and thus the machining accuracy improves. In addition, variance in the length (bristle height) of the linear abrasive members 32 from the base 31 does not occur, therefore the change of the grinding property and flexibility due to the variance is reduced. As a result, machining accuracy is stabilized.

(Main Effect of Present Embodiment)

As described above, in the polishing brush 1 of the present embodiment, the holder 2 is provided with the flow path 28 to discharge the liquid cutting agent toward the side on which the free ends 33 of the linear abrasive members 32 are located. Hence, the liquid cutting agent can be discharged from the flow path 28 toward the side on which the free ends 33 of the linear abrasive members 32 are located when a workpiece is polished by moving the polishing brush 1 or the workpiece relative to one another while the free ends 33 of the linear abrasive members 32 touch the workpiece. Hence, although cutting dust tends to clog the tips of the linear abrasive members 32 in the course of polishing, with the present embodiment, the liquid cutting agent is efficiently supplied toward the tips of the linear abrasive members 32. As a result, clogging with cutting dust is hard to occur, and therefore the polishing performance can be kept from decreasing.

In addition, in the present embodiment, the flow path 28 is opened in a region in the holder 2 surrounded by the linear abrasive members 32. Hence, in the case where the cutting agent supplied from the outside of the holder 2 is hard to enter the inside of the holder 2, the cutting agent can be supplied toward the outside from the inside of a part in which the linear abrasive members 32 are located. In particular, in the present embodiment, the polishing brush 1 rotates about the axial line L. Thus, when the cutting agent is supplied from the outside of the holder 2, the cutting agent is hard to enter the inside of the holder 2 because of centrifugal force. However, in the present embodiment, the flow path 28 is opened in a region in the holder 2 surrounded by the linear abrasive members 32. Consequently, cutting dust is efficiently flown out from between the tips of the linear abrasive members 32 and the workpiece to the outside. As a result, the effect of preventing clogging with cutting dust is large, and thus the effect of preventing a decrease in the polishing performance is large.

In addition, in the present embodiment, the base 31 holding the linear abrasive members 32 is held in the brush case 20, the flow path 28 is opened at the bottom end surface 250 (end) of the spindle 25 supporting the base 31 in the brush case 20. Consequently, a structure in which the flow path 28 is opened in the region surrounded by the linear abrasive members 32 can be made even if the base 31 is held in the brush case 20. In addition, the polishing brush 1 rotates about the axial line L passing through the spindle 25. Thus, the flow path 28 in the polishing brush 1 discharges the cutting agent on the axial line L (the rotary axial line). Hence, the cutting agent supplied from the outside of the holder 2 is hard to enter the inside of the holder 2 because of centrifugal force. However, in the present embodiment, the flow path 28 discharges the cutting agent at the center of the region surrounded by the linear abrasive members 32, and thus cutting dust is efficiently flown out from between the tips of the linear abrasive members 32 and the workpiece to the outside. As a result, the effect of preventing clogging with cutting dust is large, and thus the effect of preventing a decrease in the polishing performance is large.

In addition, in the present embodiment, each of the linear abrasive members 32 has a circular cross-sectional shape. The linear abrasive members 32 are suitable for polishing, for example, a substantially smooth surface and a smooth surface. When the linear abrasive members 32 each having a circular cross-sectional shape are used for polishing, for example, a surface or a smooth surface, the contact area between the linear abrasive members 32 and a workpiece is large, and thus the tips of the linear abrasive members 32 can be clogged with the cutting dust easily. However, applying the structure according to the present embodiment that the flow path 28 discharges the cutting agent can prevent the tips of the linear abrasive members 32 from being clogged with the cutting dust.

In addition, the linear abrasive members 32 each having a flat cross-sectional shape may be used. In this case, the linear abrasive members 32 are easily bent in the thickness direction and hard to break. Consequently, such linear abrasive members 32 are suitable for deburring, for example, a surface including a rough machined surface. In addition, the thickness of the cross-section of the linear abrasive members 32 is thinner than the width (longitudinal direction) thereof. Thus, the tips of the linear abrasive members 32 are fragile and self-sharpening effect creating a new blade is active. In addition, the linear abrasive members 32 have different bending characteristics in the thickness direction and the width direction of the cross section, thereby exhibiting irregular motion in machining. As a result, the linear abrasive members 32 have an advantage of excellent grinding ability together with the edge effect in the width direction (longitudinal direction) of the cross section. Consequently, such linear abrasive members 32 are suitable for deburring a rough machined surface. In addition, there is another advantage that the linear abrasive members 32 are thin and hard to be clogged with cutting dust.

Second Embodiment

Structure of Polishing Brush 1

Figure 4A:
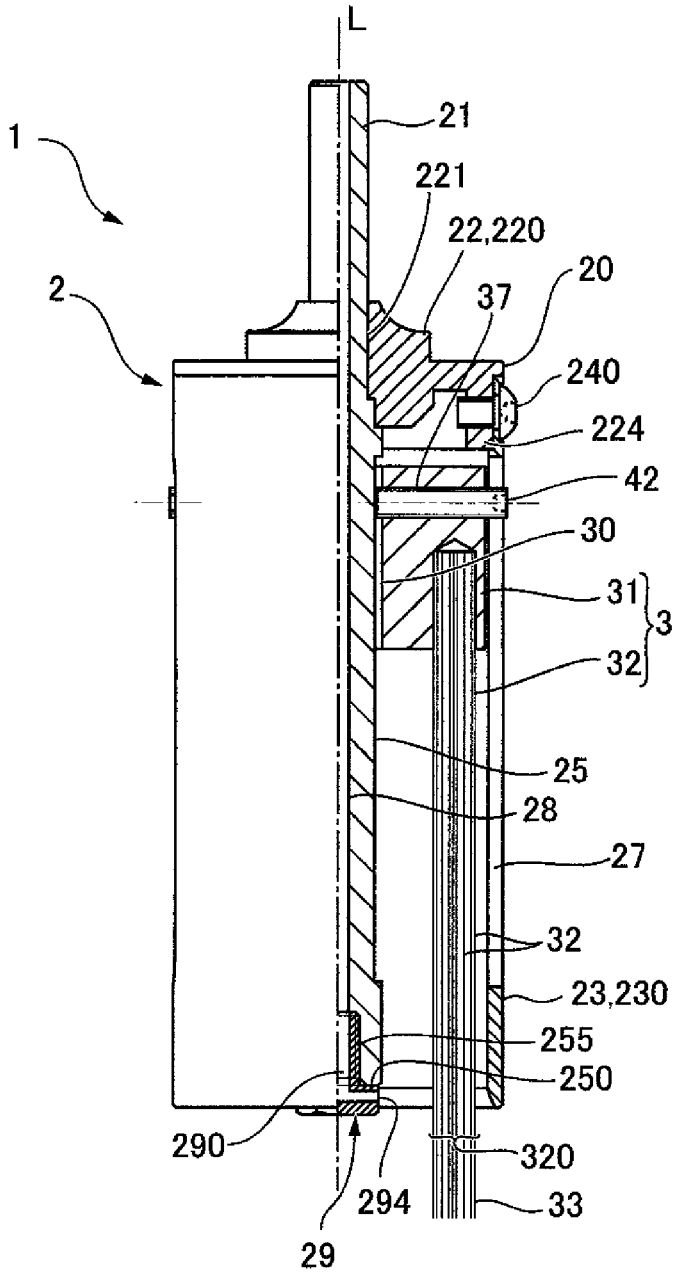
FIG. 4 is an illustration of a polishing brush according to a second embodiment of the present invention.
Figure 4B:
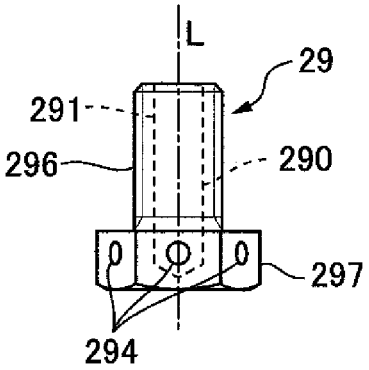
Figure 4C:
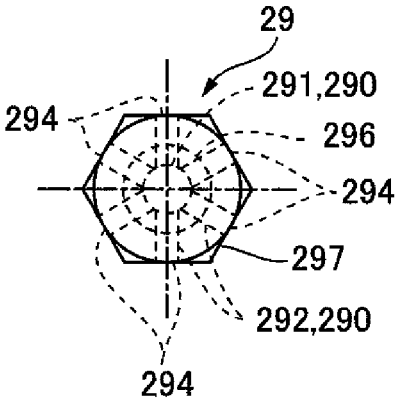

FIG. 4 is an illustration of a polishing brush 1 according to a second embodiment of the present invention. FIG. 4(*a*) is a half section illustrating a partial cut of a polishing brush according to a second embodiment. FIG. 4(*b*) is a side view of a nozzle disposed on the tip of a flow path. FIG. 4(*c*) is a bottom view of the nozzle. Note that the basic structure of the present embodiment is the same as that of the first embodiment. Hence, common reference signs are given to common components and descriptions thereof are omitted.

As illustrated in FIG. 4, similarly to the first embodiment, the polishing brush 1 of the present embodiment includes a plurality of linear abrasive members 32 each formed by hardening an aggregated yarn of inorganic filaments, such as aluminum filaments, by a resin binder, and the holder 2 that holds the linear abrasive members 32, and is used for polishing a workpiece with the free ends (tips of) the linear abrasive members 32. The holder 2 includes the metallic brush case 20 having the top to which the driving connecting shaft 21 is provided. The spindle 25 extends in the brush case 20 along the direction of the axial line L on the same axis as the peripheral wall 23. In addition, in order to provide the holder 2 with the flow path 28, a circular tube member is used as the spindle 25 in the present embodiment and the inside of the spindle 25 is provided with the flow path 28 extending along the axial line L.

In the present embodiment, the bottom end of the spindle 25 is connected to a nozzle 29 and the flow path 28 communicates with flow paths 290 provided in the nozzle 29. In addition, in the nozzle 29, the flow paths 290 are opened as discharging ports 294 at a plurality of portions in the side surfaces of the nozzle 29, toward directions intersecting with the direction of the axial line L. More specifically, the nozzle 29 is a bolt-like member screwed in a nozzle mounting hole 255 that is opened at the bottom end of the spindle 25 and has a shaft 296 on which a male screw is threaded and a head 297 having an expanded diameter at the bottom end of the shaft 296. In the shaft 296, a first flow path 291 extending in the direction of the axial line L is formed as the flow path 290. In the head 297, second flow paths 292 radially extending outward in the radial direction from the first flow path 291 are formed as the flow path 290. The second flow paths 292 are opened as discharging ports 294 at the side surfaces of the head 297.

Also in the polishing brush 1 thus structured, similarly to the first embodiment, the liquid cutting agent can be discharged from the flow path 28 toward the side on which the free ends 33 of the linear abrasive members 32 are located when a workpiece is polished by moving the polishing brush 1 or the workpiece relative to one another while the free ends 33 of the linear abrasive members 32 touch the workpiece. Hence, although cutting dust tends to clog the tips of the linear abrasive members 32 in the course of polishing, with the present embodiment, the liquid cutting agent can efficiently flow out the cutting dust. Consequently, clogging with cutting dust is hard to occur, and thus the polishing performance can be kept from decreasing.

(Evaluation Result of Polishing Performance)

Figure 5:
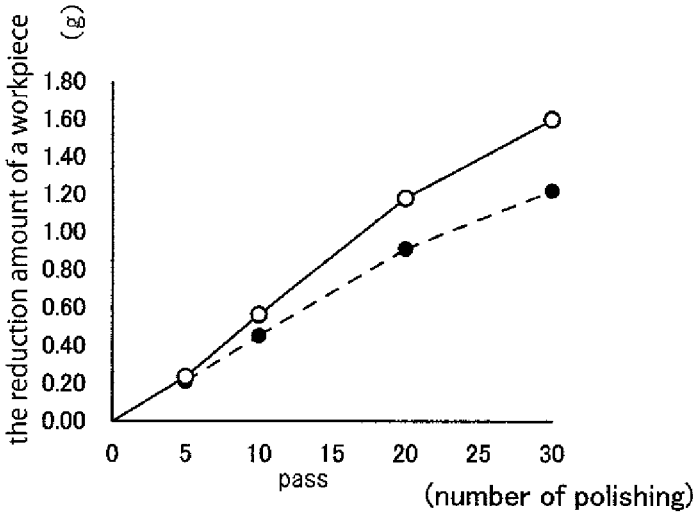
FIG. 5 is an illustration of an evaluation result of the polishing brush to which the present invention is applied.

FIG. 5 is an illustration of evaluation results of the polishing brush 1 to which the present invention has been applied. FIG. 5 illustrates a relation between the number of polishing (passing number) and the polishing amount of a workpiece (the reduction amount of a workpiece). The number of polishing in the specification means the number of repetition of polishing on the same workpiece for a certain time. Note that, in FIG. 5, solid lines and white circles illustrate the result of polishing a workpiece with the polishing brush 1 according to the second embodiment in the case where the cutting agent was discharged to the surface of the workpiece through the flow paths 28 and 290 while the cutting agent was being supplied to the surface of the workpiece from the outside. In addition, broken lines and black circles illustrate the result in the case where the cutting agent was supplied to the surface of the workpiece from the outside but was not discharged from the flow paths 28 and 290. In addition, the workpiece is made of an aluminum alloy and the projection length of the linear abrasive members 32 from the bottom end of the brush case 20 is 10.8 mm.

It is obvious from the result shown by the white circles and the solid lines in FIG. 5 that, when the workpiece was polished with the polishing brush 1 according to the second embodiment in the case where the cutting agent was discharged to the surface of the workpiece through the flow paths 28 and 290 while the cutting agent was being supplied to the surface of the workpiece from the outside, polishing efficiency was maintained at a higher level than that in the comparative example where the cutting agent is supplied to the surface of the workpiece exclusively from the outside (refer to the result shown by the black circles and the broken lines).

In addition, the observation of the tips of the linear abrasive members 32 after the polishing found that, when the workpiece was polished with the polishing brush 1 according to the second embodiment in the case where the cutting agent was discharged to the surface of the workpiece through the flow paths 28 and 290 while the cutting agent was being supplied to the surface of the workpiece from the outside, the amount of cutting dust clogged in the tips of the linear abrasive members 32 is smaller than that in the case where the cutting agent is supplied to the surface of the workpiece exclusively from the outside.

Modification of First Embodiment and Second Embodiment

In the first embodiment, the discharging port 280 is opened exclusively in the direction of the axial line L. In the second embodiment, the discharging ports 294 are opened exclusively in the directions intersecting with the axial line L. However, a structure having discharging ports opening in the direction of the axial line L and in the directions intersecting with the axial line L may be adopted.

Third Embodiment

Structure of Polishing Brush 5

Figure 6A:
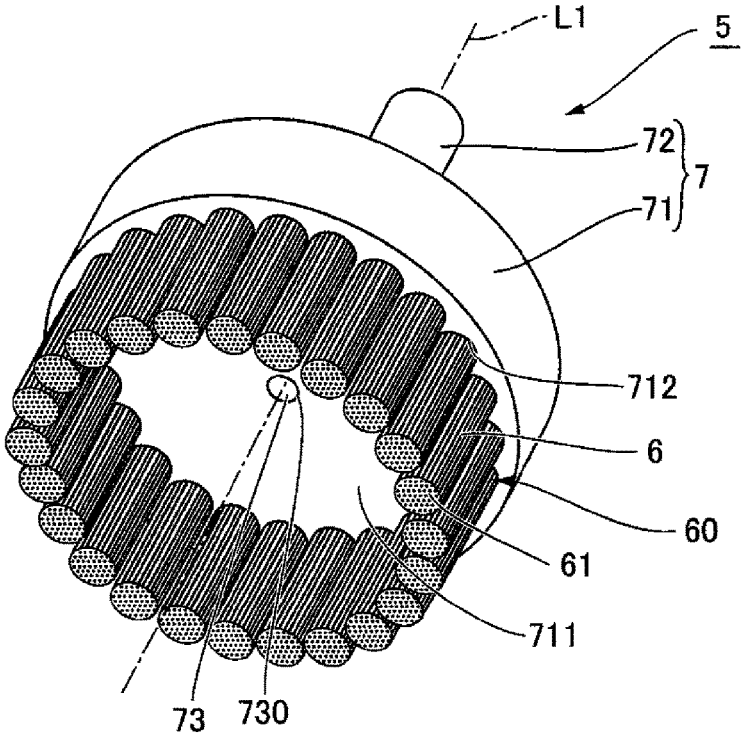
FIG. 6 is an illustration of a polishing brush according to a third embodiment of the present invention.
Figure 6B:
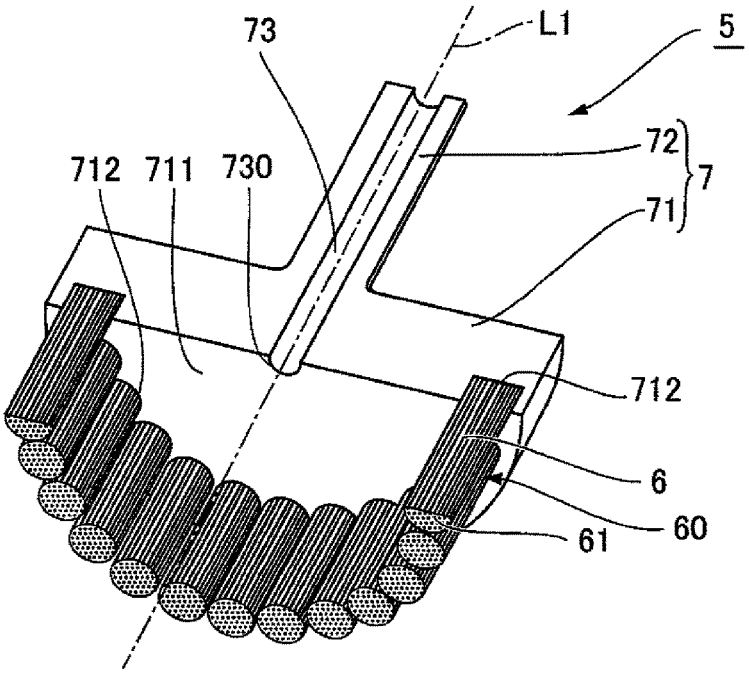
Figure 7A:
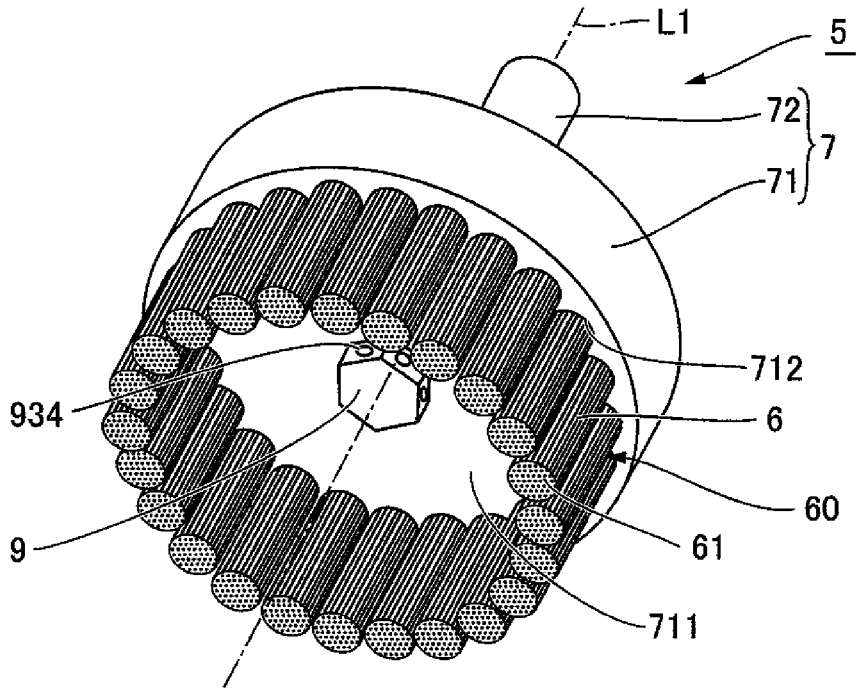
FIG. 7 is an illustration of a polishing brush according to a fourth embodiment of the present invention.
Figure 7B:
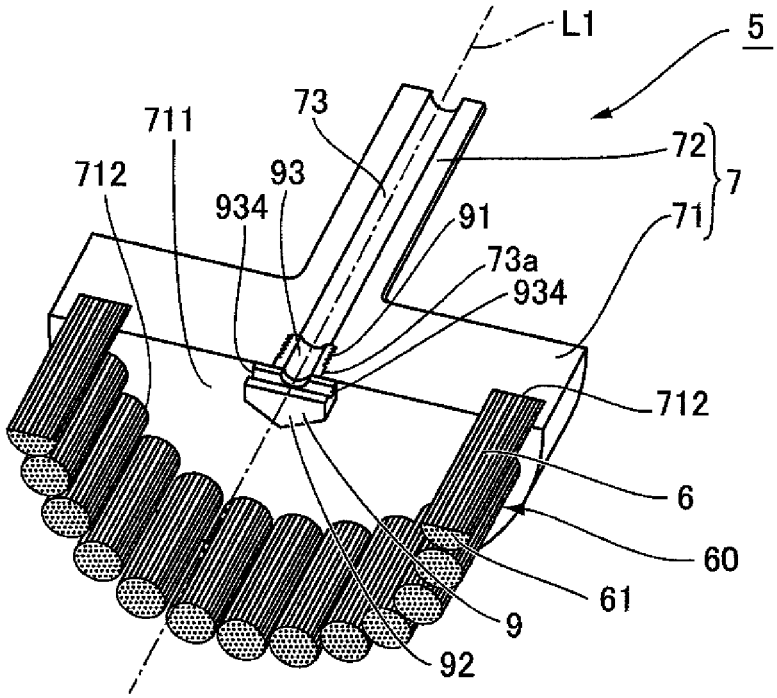
Figure 7C:
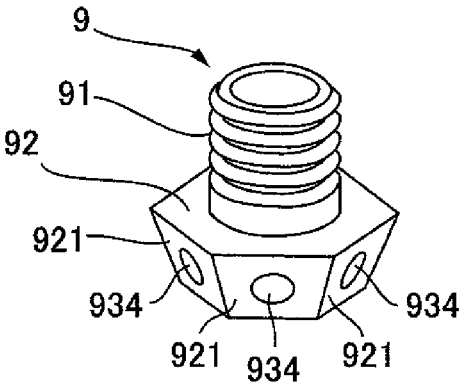
Figure 7D:
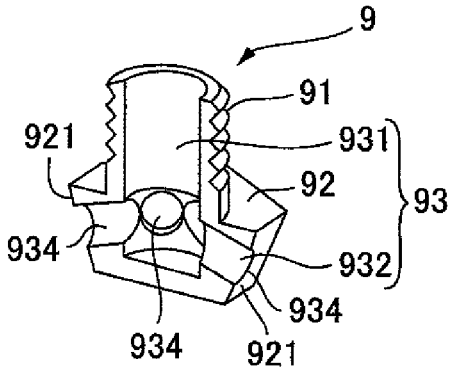

FIG. 6(*a*) is a perspective view of a polishing brush 5 according to a third embodiment of the present invention seen from linear abrasive members 6. FIG. 6(*b*) is a sectional view of the polishing brush 5 in FIG. 6(*a*) taken along a plane including a center axial line L1 of a holder 7. As illustrated in FIG. 6, the polishing brush 5 according to the present embodiment is a brush-like grinding stone and includes a plurality of linear abrasive members 6 and the holder 7 that holds the linear abrasive members 6. The polishing brush 5 polishes a workpiece with free ends 61 (tips) of the linear abrasive members 6.

Similarly to the first embodiment, the linear abrasive members 6 are each formed by hardening an aggregated yarn of inorganic filaments, such as aluminum filaments, by a resin binder. The holder 7 includes a disk-shaped base 71 that holds the linear abrasive members 6, and a driving connecting shaft (shank) 72 configured to enable connection to a rotary driving unit of a polishing machine. The base 71 and the driving connecting shaft 72 are arranged coaxially and integrally formed.

The outer circumferential part of one circular end surface 711 on the base 71 is provided with grinding-stone holding holes 712 arranged at a regular angular distance around the center axial line L1 of the holder 7 (the axial line of the driving connecting shaft 72). Bundles 60 obtained by bundling up the linear abrasive members 6 are secured by inserting the base ends opposite to the free ends 61 thereof in the respective grinding-stone holding holes 712. The linear abrasive members 6 are extending along the axial line L in the state that the linear abrasive members 6 are held by the base 71.

The driving connecting shaft 72 protrudes from the base 71 to the opposite side of the side where the free ends 61 of the linear abrasive members 6 are located. The holder 7 is provided with a flow path 73 extending in the direction of the center axial line L1 and through the driving connecting shaft 72 and the base 71. The flow path 73 is opened as a discharging port 730 in a region in the holder 7 (the base 71) surrounded by the linear abrasive members 6.

Also in the polishing brush 5 thus structured, similarly to the first embodiment, the liquid cutting agent can be discharged from the flow path 73 toward the side on which the free ends 61 of the linear abrasive members 6 are located when a workpiece is polished by moving the polishing brush 5 or the workpiece relative to one another while the free ends 61 of the linear abrasive members 6 touch the workpiece. Hence, although cutting dust tends to clog the tips of the linear abrasive members 6 in the course of polishing, with the present embodiment, the liquid cutting agent can efficiently flow out the cutting dust. Consequently, clogging with cutting dust is hard to occur, and thus the polishing performance can be kept from decreasing.

Fourth Embodiment

Structure of Polishing Brush 5

FIG. 7(*a*) is a perspective view of the polishing brush 5 according to a fourth embodiment of the present invention seen from the linear abrasive members 6. FIG. 7(*b*) is a sectional view of the polishing brush 5 in FIG. 7(*a*) taken along a plane including the center axial line L1 of the holder 7. FIG. 7(*c*) is a perspective view of a nozzle 9 attached to the holder 7. FIG. 7(*d*) is a sectional view of the nozzle 9 illustrated in FIG. 7(*c*). Note that the basic structure of the present embodiment is the same as that of the third embodiment. Hence, common reference signs are given to common components and descriptions thereof are omitted.

As illustrated in FIG. 7(*a*) and FIG. 7(*b*), the polishing brush 5 according to the present embodiment includes a plurality of linear abrasive members 6 and the holder 7 that holds the linear abrasive members 6, and the nozzle 9 attached to the holder 7. The polishing brush 5 polishes a workpiece with the free ends 61 (tips) of the linear abrasive members 6.

As illustrated in FIG. 7(*c*), the nozzle 9 is a bolt-like member that has a shaft 91 on which a male screw is threaded and a hexagonal head 92 having an expanded diameter at the bottom end of the shaft 91. Six surfaces constituting the side surfaces of the head 92 are slopes 921, each of which is declined inward as being away from the shaft 91. In the shaft 91, a first flow path 931 extending in the direction of the axial line L1 is formed as an in-nozzle flow path 93. In the head 92, six second flow paths 932 that are declined outward in the radial direction from the first flow path 931 toward the direction away from the shaft 91 are radially provided as the in-nozzle flow path 93. The ends of the second flow paths 932 are opened as discharging ports 934 at the respective side surfaces (slopes 921) of the head 92.

As illustrated in FIG. 7(*b*), the open end of the flow path 73 in the base 71 is a nozzle mount 73*a* threaded with a female screw to which the male screw of the nozzle 9 is fit. The nozzle 9 is secured to the holder 7 (base 71) by screwing the shaft 91 to the nozzle mount 73*a*. The flow path 73 communicates with the in-nozzle flow path 93 provided in the nozzle 9 when the nozzle 9 is secured to the holder 7. The nozzle 9 directs the discharge of the cutting agent discharged through the flow path 73 to the side on which the linear abrasive members 6 are located.

Also in the polishing brush 5 thus structured, similarly to the first embodiment, the liquid cutting agent can be discharged from the flow path 73 toward the side on which the free ends 61 of the linear abrasive members 6 are located when a workpiece is polished by moving the polishing brush 5 or the workpiece relative to one another while the free ends 61 of the linear abrasive members 6 touch the workpiece. Hence, although cutting dust tends to clog the tips of the linear abrasive members 6 in the course of polishing, with the present embodiment, the liquid cutting agent can efficiently flow out the cutting dust. Consequently, clogging with cutting dust is hard to occur, and thus the polishing performance can be kept from decreasing. In addition, the linear abrasive members 6 can be cooled by injecting the cutting agent discharged from the nozzle 9 to the linear abrasive members 6.

Fifth Embodiment

Structure of Polishing Brush 5A

Figure 8A:
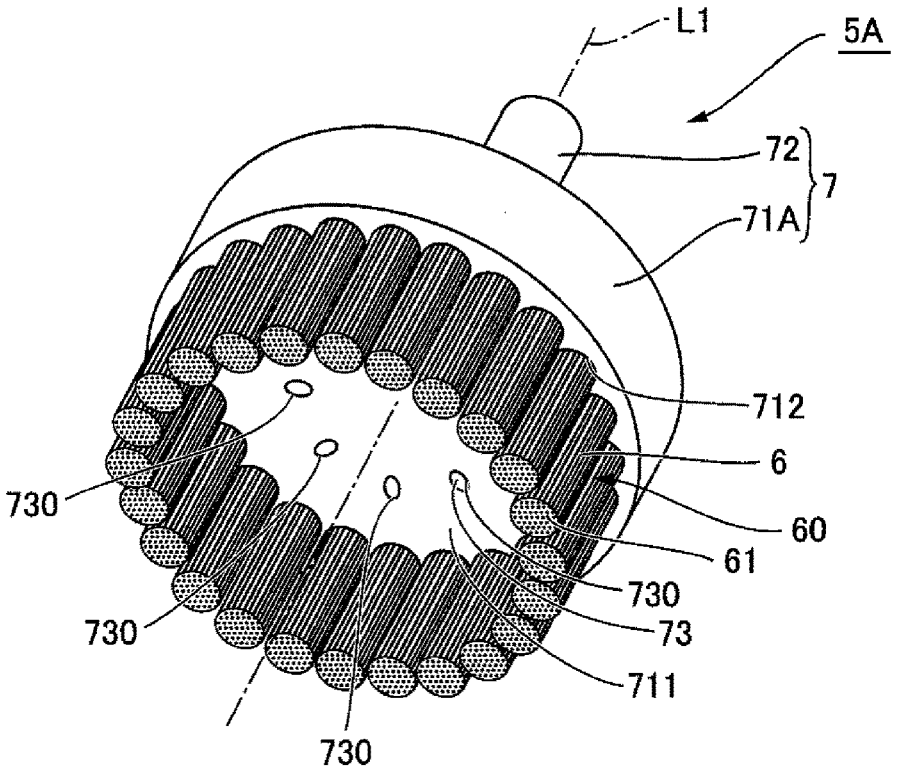
FIG. 8 is an illustration of a polishing brush according to a fifth embodiment of the present invention.
Figure 8B:
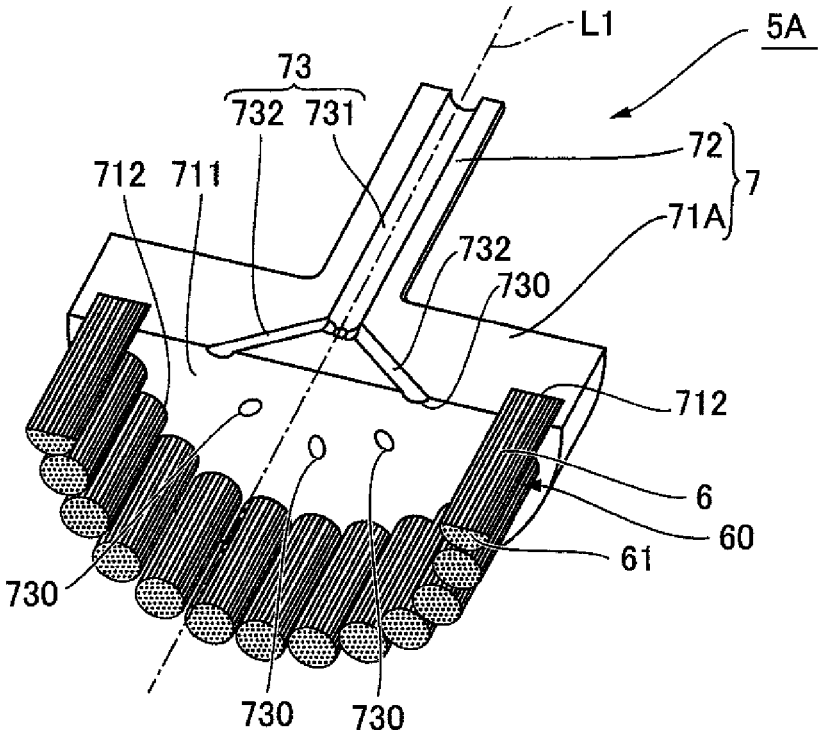

FIG. 8(*a*) is a perspective view of a polishing brush 5A according to a fifth embodiment of the present invention seen from the linear abrasive members 6. FIG. 8(*b*) is a sectional view of the polishing brush 5A in FIG. 8(*a*) taken along a plane including the center axial line L1 of the holder 7. Note that the basic structure of the present embodiment is the same as that of the third embodiment. Hence, common reference signs are given to common components and descriptions thereof are omitted.

As illustrated in FIG. 8, the polishing brush 5A according to the present embodiment includes a plurality of linear abrasive members 6 and the holder 7 that holds the linear abrasive members 6. The polishing brush 5A polishes a workpiece with the free ends 61 (tips) of the linear abrasive members 6. The holder 7 includes a disk-shaped base 71A that holds the linear abrasive members 6, and the driving connecting shaft (shank) 72 configured to enable connection to a rotary driving unit of a polishing machine. The base 71A and the driving connecting shaft 72 are arranged coaxially and integrally formed.

In the present embodiment, a first flow path 731 extending in the direction of the center axial line L1 and through the driving connecting shaft 72 to the base 71A is provided as the flow path 73. In addition, a plurality of second flow paths 732 that are declined outward in the radial direction from the first flow path 731 toward the direction away from the driving connecting shaft 72 are radially provided as the flow path 73. The ends of the second flow paths 732 are the openings of the flow path 73 and are opened as discharging ports 730 in a region in the holder 7 (base 71A) surrounded by the linear abrasive members 6.

Also in the polishing brush 5A thus structured, similarly to the first embodiment, the liquid cutting agent can be discharged from the flow path 73 toward the side on which the free ends 61 of the linear abrasive members 6 are located when a workpiece is polished by moving the polishing brush 5A or the workpiece relative to one another while the free ends 61 of the linear abrasive members 6 touch the workpiece. Hence, although cutting dust tends to clog the tips of the linear abrasive members 6 in the course of polishing, with the present embodiment, the liquid cutting agent can efficiently flow out the cutting dust. Consequently, clogging with cutting dust is hard to occur, and thus the polishing performance can be kept from decreasing. In addition, in the present embodiment, the cutting agent discharged from the discharging ports 730 moves toward the outer circumferential side, and thus the linear abrasive members 6 can be cooled by applying the cutting agent onto the linear abrasive members 6.

Although the linear abrasive members 6 in the above-described embodiments each include an aggregated yarn of inorganic filaments, an article made of a nylon, a nylon with abrasive grain, a rubber with abrasive grain, a stainless steel, or a brass can be used as the linear abrasive members.

The invention claimed is:

1. A polishing brush comprising:

a plurality of linear abrasive members;

a holder that holds the linear abrasive members; and a nozzle secured to the holder, wherein the holder is provided with a flow path to discharge a liquid cutting agent toward a side on which free ends of the linear abrasive members are located, and the holder includes a base that holds base ends of the linear abrasive members, and a brush case that holds therein the base so that the free ends of the linear abrasive members project from an open end of the brush case, the brush case is provided with a spindle extending in the brush case along a direction of an axial line thereof, the base is provided with a shaft hole into which the spindle fits in a region surrounded by the linear abrasive members, the flow path extends in the spindle in the direction of the axial line and is opened in the direction of the axial line in a region surrounded by the linear abrasive members at an end of the spindle on the side on which the free ends of the linear abrasive members are located, and the nozzle is a bolt-like member screwed in a nozzle mounting hole opened at the end of the spindle so as to communicate with the flow path, and the nozzle directs the cutting agent so as to be discharged toward the free ends of the linear abrasive members which are located at a distance from the nozzle.

2. The polishing brush according to claim 1, wherein the brush case includes a peripheral wall provided with a groove-like guide hole extending in the direction of the axial line, the base is provided with a screw hole reaching the shaft hole from an outer circumferential surface of the base, and the base is held between the spindle and the peripheral wall with a set screw, the set screw being screwed in the screw hole through the guide hole so that a tip of the set screw contacts an outer circumferential surface of the spindle.

3. The polishing brush according to claim 2, wherein the spindle constitutes a shank that projects from the brush case to an opposite side of the side on which the free ends of the linear abrasive members are located and enables connection to a rotary driving unit of a polishing machine.

4. A polishing brush comprising:

a plurality of linear abrasive members;

a holder that holds the linear abrasive members; and a nozzle secured to the holder, wherein the holder is provided with a flow path to discharge a liquid cutting agent toward a side on which free ends of the linear abrasive members are located, and the holder includes a base that holds base ends of the linear abrasive members, and a shank configured to enable connection to a rotary driving unit of a polishing machine, the shank projects from the base to an opposite side of the side on which the free ends of the linear abrasive members are located, the flow path passes through the shank and the base, and is opened in the direction of an axial line in the base in a region surrounded by the linear abrasive members, and the nozzle is a bolt-like member screwed in a nozzle mounting hole provided at the base so as to communicate with the flow path, and the nozzle directs the cutting agent so as to be discharged toward the free ends of the linear abrasive members are located at a distance from the nozzle.

5. The polishing brush according to claim 1, wherein the linear abrasive members each include an aggregated yarn of inorganic filaments.

6. The polishing brush according to claim 5, wherein the linear abrasive members each have a circular cross-sectional shape.

7. The polishing brush according to claim 4, wherein the linear abrasive members each include an aggregated yarn of inorganic filaments.

8. The polishing brush according to claim 7, wherein the linear abrasive members each have a circular cross-sectional shape.

9. The polishing brush according to claim 4, wherein the nozzle is configured so that the cutting agent is discharged from the nozzle in a direction which forms an angle with a direction perpendicular to the axial line.

* * * * *